US011920437B2

(12) United States Patent
Zhang et al.

(10) Patent No.: US 11,920,437 B2
(45) Date of Patent: Mar. 5, 2024

(54) WELL DRILLING ACCELERATION TOOL

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Haiping Zhang, Beijing (CN); Shidong Ding, Beijing (CN); Mingguang Sun, Beijing (CN); Jiachang Wang, Beijing (CN); Yanbin Zang, Beijing (CN); Xinghua Tao, Beijing (CN); Lishuang Wang, Beijing (CN); Xiaodan Liu, Beijing (CN); Lingchao Xuan, Beijing (CN); Renlong Zhang, Beijing (CN)

(73) Assignees: China Petroleum & Chemical Corporation, Beijing (CN); Sinopec Petroleum Engineering Technology Research Institute Co., Ltd., Beijing (CN)

( * ) Notice: Subject to any disclaimer, the term of this patent is extended or adjusted under 35 U.S.C. 154(b) by 59 days.

(21) Appl. No.: 17/757,059

(22) PCT Filed: Sep. 11, 2020

(86) PCT No.: PCT/CN2020/114859
§ 371 (c)(1),
(2) Date: Jun. 8, 2022

(87) PCT Pub. No.: WO2021/120721
PCT Pub. Date: Jun. 24, 2021

(65) Prior Publication Data

US 2023/0003084 A1 Jan. 5, 2023

(30) Foreign Application Priority Data

Dec. 16, 2019 (CN) ..... 201911294292.3

(51) Int. Cl.
*E21B 4/10* (2006.01)
*E21B 4/14* (2006.01)

(52) U.S. Cl.
CPC . *E21B 4/10* (2013.01); *E21B 4/14* (2013.01)

(58) Field of Classification Search
CPC ... E21B 4/10; E21B 4/14; E21B 4/003; E21B 4/16; E21B 1/14–16
See application file for complete search history.

(56) References Cited

U.S. PATENT DOCUMENTS 2,495,364 A * 1/1950 Clapp ..... E21B 4/10 175/298
3,223,187 A * 12/1965 Cleary ..... E21B 17/073 175/320

(Continued)

FOREIGN PATENT DOCUMENTS

CA 2816470 A1 5/2012
CN 103174380 A 6/2013

(Continued)

OTHER PUBLICATIONS

English translation of CN_105275384_A, Zhang, 2016 (Year: 2016).*

*Primary Examiner* — Steven A MacDonald
(74) *Attorney, Agent, or Firm* — NKL Law; Allen Xue

(57) ABSTRACT

A speed-enhancing drilling tool includes an upstream drill string (10), which has a drive motor and a first driving rod coupled therewith, a downstream drilling bit; and a percussive device connected between the upstream drilling string and the downstream drilling bit. The first driving rod extending axially and the drive motor are configured to drive the first driving rod in rotation. The percussive device has a rotary driving part having an upper end engaged with the first driving rod to rotate together therewith; and a rotary working part having an upper end engaged with a lower end of the rotary driving part and a lower end connected with the (Continued)

downstream drilling bit. The rotary working part can be driven by the rotary driving part to rotate about its axis, and axially movable relative thereto; and a percussion generating part arranged around the rotary working part.

17 Claims, 11 Drawing Sheets

(56) References Cited

U.S. PATENT DOCUMENTS 4,408,670 A 10/1983 Schoeffler
4,705,118 A * 11/1987 Ennis ..... E21B 6/06 175/65
5,368,110 A * 11/1994 French ..... E21B 4/003 175/57
6,082,457 A * 7/2000 Best ..... E21B 17/05 166/301
7,311,157 B1 * 12/2007 Clarke ..... E21B 7/067 175/74
7,882,906 B1 * 2/2011 DeCuir, Sr. ..... E21B 31/005 173/205
10,538,968 B2 * 1/2020 Chen ..... E21B 4/14
10,590,705 B2 * 3/2020 Sheehan ..... E21B 4/10
10,961,788 B2 * 3/2021 Russo ..... E21B 17/05
2002/0166700 A1 11/2002 Gillis et al.
2004/0238219 A1 * 12/2004 Nichols ..... E21B 17/07 175/320
2010/0187016 A1 * 7/2010 Marshall ..... E21B 4/14 29/428
2012/0118648 A1 * 5/2012 Lorger ..... E21B 4/14 175/296
2013/0186689 A1 * 7/2013 Garcia ..... E21B 4/14 175/320
2015/0361730 A1 * 12/2015 Russo ..... E21B 17/06 166/381
2016/0340983 A1 * 11/2016 Bruandet ..... E21B 4/14
2018/0163474 A1 * 6/2018 Kartha ..... E21B 6/02
2018/0171717 A1 * 6/2018 Chen ..... E21B 4/006
2021/0301593 A1 * 9/2021 Mcmillan ..... E21B 1/14

FOREIGN PATENT DOCUMENTS

CN 103244052 A 8/2013
CN 105156027 A 12/2015
CN 105275384 A 1/2016
CN 204941340 U 1/2016
CN 105421996 A 3/2016
CN 105672873 A 6/2016
CN 109098654 A 12/2018
CN 208734274 U 4/2019

* cited by examiner

WELL DRILLING ACCELERATION TOOL

CROSS REFERENCE OF RELATED APPLICATION

This application is a U.S. national stage entry of PCT International Application No. PCT/CN2020/114859, filed on Sep. 11, 2020, which claims the priority of Chinese patent application No. 201911294292.3, entitled "Well Drilling Acceleration Tool" and filed on Dec. 16, 2019, the entire content of which is incorporated herein by reference.

TECHNICAL FIELD

The present invention relates to the technical field of well drilling, in particular to a speed-enhancing drilling tool, which can be used for drilling speed enhancement in oil and gas exploration and exploitation, and in mines, quarries, geological investigations, water wells, geothermal fields, or the like as well.

TECHNICAL BACKGROUND

With the developments of exploration and exploitation of oil and gas resources toward deep formations, speed enhancement for drilling tools in deep/ultra-deep wells has increasingly become a technical problem that needs to be solved urgently in the field. In order to improve the ROP for drilling in the deep/ultra-deep wells, a variety of percussion drilling tools has been developed, which generates a good effect in speed enhancement. However, these tools are generally immature. The lifespan of percussion drilling tools in oil drilling applications has always been a bottleneck restricting the development of this technology.

Practice has proved that a combination of compound dual-drive drilling technology with rotary percussive drilling technology brings about a remarkable effect in speed enhancement. The compound dual-drive drilling technology preferably adopts a high-power motor drilling tool to improve rotational speed and cutting strength. In the rotary percussive drilling process, the WOB keeps cutting teeth in close contact with the rock, and the percussive load can instantly increase the rock crushing work ratio. The cracks generated are impacted under the high rotational speed of the screw, further promoting rock crushing and rotary shear breaking, thereby improving rock-breaking efficiency.

SUMMARY OF THE INVENTION

In view of some or all of the above problems, the present invention proposes a speed-enhancing drilling tool, which combines advantages of the compound dual-drive drilling technology, the rotary percussive drilling technology and the elastic energy storage principle together, achieving comprehensive functions of high-power rotary torque, adjustable percussive energy and high-speed rotary cutting, thereby generating a significant effect in speed enhancement and indicating excellent application prospect.

According to the present invention, a speed-enhancing drilling tool is proposed, comprising: an upstream drill string, including a drive motor and a first driving rod coupled with the drive motor, wherein the first driving rod extends in an axial direction, and the drive motor is configured to drive the first driving rod in rotation; a downstream drilling bit; and a percussive device, which is connected between the upstream drilling string and the downstream drilling bit and configured to generate impact on the downstream drilling bit in the axial direction. The percussive device comprises: a rotary driving part, which is configured to rotate around its axis, and has an upper end engaged with the first driving rod to rotate together with the first driving rod; a rotary working part, which has an upper end engaged with a lower end of the rotary driving part and a lower end connected with the downstream drilling bit, wherein the rotary working part is configured to be driven by the rotary driving part to rotate about its axis, and axially movable relative to the rotary driving part; and a percussion generating part arranged around the rotary working part and having an upper end abutting against an elastic member, wherein the percussion generating part is configured to move along the axial direction relative to the rotary working part, so as to impact the rotary working part downwardly along the axial direction under action of the elastic member.

With the help of the elastic member, the percussion generating part can repeatedly impact on the rotary working part, which is connected with the downstream drilling bit, along the axial direction. Accordingly, the impact energy is transmitted to the downstream drilling bit, which applies impact on the formation. In this manner, the downstream drilling bit can impact the formation while performing rotary drilling operations. This compound action facilitates to break up the formation rapidly, which can increase drilling efficiency and reduce drilling cost.

In one embodiment, the rotary driving part comprises a second driving rod connected at a lower end of the first driving rod, and the second driving rod comprises an upstream segment and a downstream segment connected to the upstream segment. An outer diameter of the upstream segment is smaller than that of the downstream segment. A lower driving tooth with an upwardly facing surface is formed on an outer wall of the second driving rod at an area connecting the upstream segment with the downstream segment. The percussion generating part comprises a percussive sleeve arranged around the second driving rod. The percussive sleeve includes a first sleeve segment and a second sleeve segment located below and connected with the first sleeve segment. An inner diameter of the first sleeve segment is smaller than that of the second sleeve segment. An upper driven tooth with a downwardly facing surface is formed on an inner wall of the percussive sleeve at an area connecting the first sleeve segment with the second sleeve segment. The percussive sleeve is able to reciprocally move axially relative to the second driving rod under cooperation of the lower driving tooth and the upper driven tooth when the second driving rod rotates relative to the percussive sleeve.

In one embodiment, the upper driven tooth and the lower driving tooth are each configured with an upward tooth segment that is inclined upwardly in a direction opposite to a rotating direction, and a downward tooth segment that is connected with the upward tooth segment and inclined downwardly in the direction opposite to the rotating direction, wherein an inclination of the upward tooth segment is smaller than that of the downward tooth segment.

In one embodiment, the rotary working part comprises a rotary rod, which has a lower end connected with the downstream drilling bit, and an upper end connected with the lower end of the second driving rod through a key, so that the rotary rod is fixed relative to the second driving rod in a circumferential direction but moveable relative thereto in the axial direction.

In one embodiment, multiple driving keys extending in the axial direction are formed at the lower end of the second driving rod, and spaced apart from each other in the circumferential direction. Multiple mating keys extending in the axial direction are formed at the upper end of the rotary rod, and spaced apart from each other in the circumferential direction. Said multiple driving keys and said multiple mating keys are alternately mated with each other in the circumferential direction.

In one embodiment, the driving keys extending in the axial direction are formed on an outer side wall at the lower end of the second driving rod. Driving slots extending in the axial direction are formed on an outer side wall of the upper end of the rotary rod. Each driving key is inserted into a corresponding driving slot to move in said corresponding drive slot along the axial direction.

In one embodiment, the rotary rod comprises a first rotating segment, and a second rotating segment located below and connected with the first rotating segment. An outer diameter of the first rotating segment is smaller than that of the second rotating segment. A step surface facing upward is formed at an area connecting the first rotating segment with the second rotating segment. A lower end face of the percussive sleeve is opposite to the step surface, and an axial gap exists between the upper driven tooth and the lower driving tooth when the lower end face of the percussive sleeve is in contact with the step surface.

In one embodiment, an accommodating groove is formed on an outer side wall of the second rotating segment, and a limiting block protruding radially outward relative to the outer side wall of the second rotating segment is arranged in the accommodating groove. The percussive device further includes an outer shell, at least a part of which surrounds the second rotating segment, so that the limiting block is sandwiched between the second rotating segment and the outer shell. A wear-resistant joint is connected to a lower end of the outer shell, and has an upper end inserted into the lower end of the outer shell. An upper end face of the wear-resistant joint is opposite to the limiting block, for restricting axial movement range of the limiting block. The limiting block includes a first matching segment and a second matching segment located below and connected with the first matching segment. An outer diameter of the first matching segment is smaller than that of the second matching segment. An outer side wall of the second matching segment is in engagement with an inner wall of the outer shell, while a separating space is formed between the first matching segment and the outer shell. A mounting sleeve is provided between the outer shell and the second rotating segment in an area above the limiting block. The mounting sleeve extends into the separating space to maintain a radial position of the limiting block.

In one embodiment, an orienting key extending in the axial direction is formed on an outer side wall of the percussive sleeve. The percussive device further includes an outer shell, at least a part of which surrounds the percussive sleeve, and an orienting slot extending in the axial direction is formed on an inner side wall of the outer shell. The orienting key is inserted into the orienting slot and moveable in the orienting slot along the axial direction, so that the percussive sleeve is fixed relative to the outer shell in the circumferential direction, but moveable relative thereto along the axial direction.

In one embodiment, the elastic member is arranged above the percussive sleeve, and a washer is arranged between the percussive sleeve and the elastic member. The washer is provided with a through hole axially passing through the washer, the through hole being configured to allow fluid to pass therethrough during compression and recovery of the elastic member.

Compared with the prior arts, the present invention has the advantages as follows. The percussion generating part, with the help of the elastic member, repeatedly impacts on the rotary working part, which is connected with the downstream drilling bit, in the axial direction.

Accordingly, the impact energy is transmitted to the downstream drilling bit, which applies impact on the formation. In this manner, the downstream drilling bit can impact the formation while performing rotary drilling operations. This compound action facilitates to break up the formation rapidly, which can increase drilling efficiency and reduce drilling cost.

BRIEF DESCRIPTION OF THE DRAWINGS

In the following the present invention will be explained in more detail by way of embodiments with reference to the accompanying drawings. In the drawings.

In the drawings, the same reference numerals are used to indicate the same components. The drawings are not drawn to actual scale.

DETAILED DESCRIPTION OF EMBODIMENTS

The present invention will be further described below in conjunction with the accompanying drawings.

Figure 1:
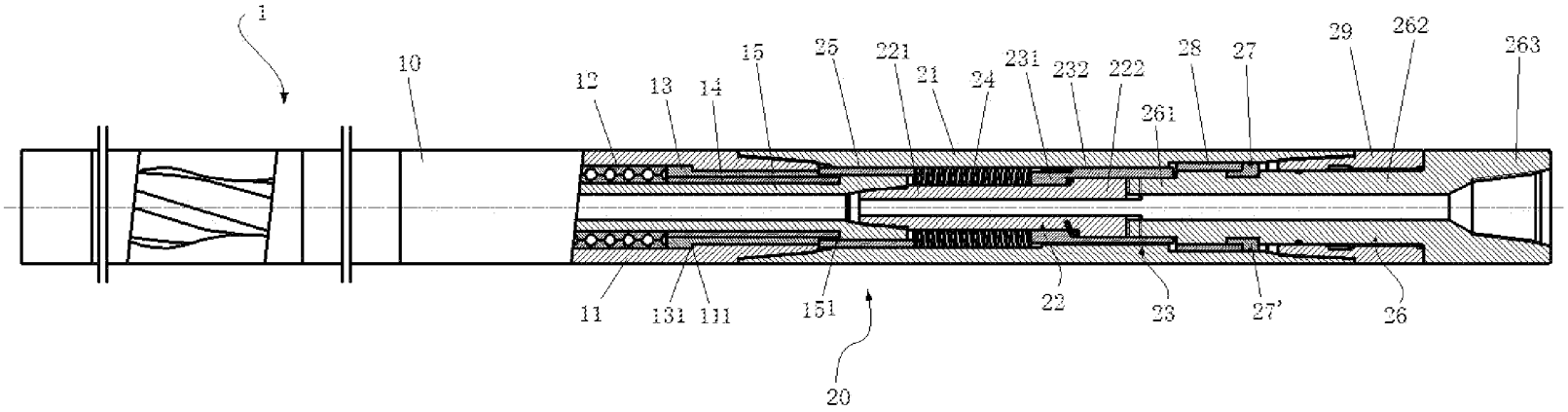
FIG. 1 schematically shows a speed-enhancing drilling tool according to one embodiment of the present invention.

FIG. 1 schematically shows an embodiment of a speed-enhancing drilling tool 1 according to the present invention. The speed-enhancing drilling tool 1 includes an upstream drilling string 10, a percussive device 20, and a downstream drilling bit (not shown), which are arranged in this order from top to bottom.

The upstream drilling string 10 may be, for example, a known volumetric screw drilling pipe, or a portion thereof, which includes a drive motor for driving the downstream drill bit to perform rotary drilling operations, and a first driving rod 15 connected at a lower end of the drive motor. The first driving rod 15 extends along an axial direction. The drive motor may be driven by fluid flowing through the upstream drilling string, so as to drive the first driving rod 15 to rotate about its axis.

As shown in FIG. 1, the upstream drilling string 10 includes a drilling tool housing 11, in which the first driving rod 15 is located, with a bearing pack 12 and a swivel bearing being arranged between the first driving rod 15 and the drilling tool housing 11. The swivel bearing includes a wear-resistant static bearing ring 13 and a wear-resistant movable bearing ring 14, for allowing the first driving rod 15 to rotate freely relative to the drilling tool housing 11.

Specifically, an outer wall of the wear-resistant static bearing ring 13 is provided with a first step surface 131, which faces downward and matches with a second step surface 111 formed on an inner wall of the housing 11, so that an upper end face of the wear-resistant static bearing ring 13 axially presses against an outer ring of the bearing pack 12. The wear-resistant movable bearing ring 14 is fixedly arranged on an outer wall of the first driving rod 15, in order to engage with the wear-resistant static bearing ring 13 from outside. In the axial direction, the wear-resistant movable bearing ring 14 has an upper end face arranged opposite to an inner ring of the bearing pack 12, and a lower end face arranged opposite to a third step surface 151 formed on the outer wall of the first driving rod 15, so that the inner ring of the bearing pack 12 is pressed tight axially.

The percussive device 20 includes a rotary driving part, a rotary working part, and a percussion generating part. As shown in FIG. 1, the rotary driving part may include a second driving rod 22 located below and connected with the first driving rod 15. Moreover, the rotary working part may include a rotary rod 26 located below and connected with the second driving rod 22. The percussion generating part includes a percussive sleeve 23 arranged around the second driving rod 22 and the rotary rod 26. The rotary rod 26 rotates with the second driving rod 22, but the percussive sleeve 23 not.

An upper end of the second driving rod 22 is fixedly connected with a lower end of the first driving rod 15. For example, the upper end of the second driving rod 22 is configured as a tapered portion, which can be inserted into an inner chamber at the lower end of the first driving rod 15 and connected with an inner wall of the first driving rod 15 through threads. For another example, the above-mentioned thread can be designed according to the thread standard for drill pipe joint. In particular, when the second driving rod 22 is, for example, a 7-inch round pipe, the thread can also be designed with a smaller thread model in the thread standard of drill pipe joint, such as NC23 or NC26.

Figure 2:
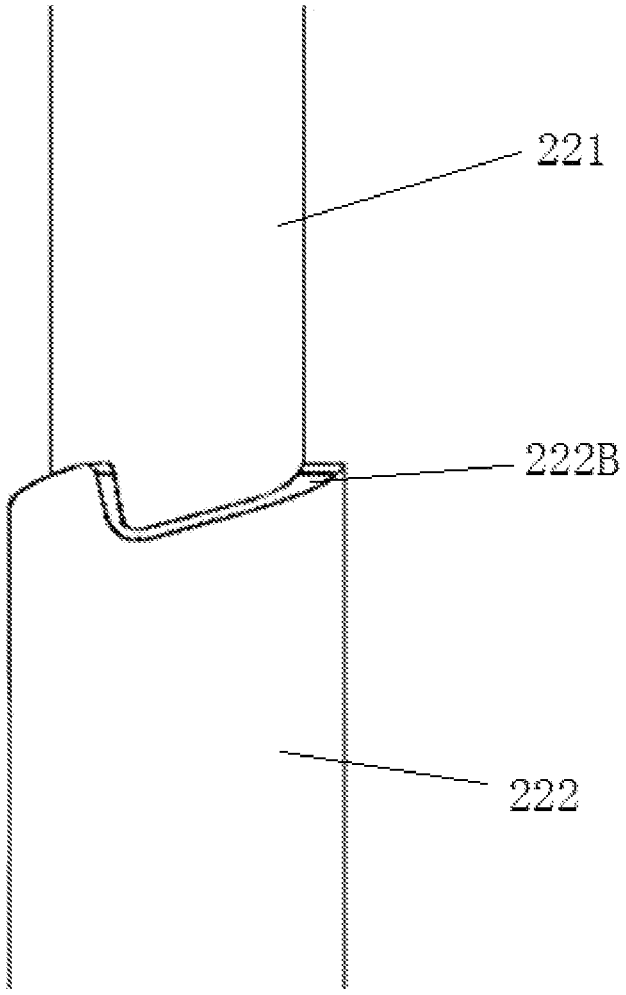
FIG. 2 shows an embodiment of a second driving rod of the speed-enhancing drilling tool of FIG. 1.

As shown in FIG. 2, the second driving rod 22 includes an upstream segment 221 having a relatively small outer diameter, and a downstream segment 222 having a relatively large outer diameter, which is located below and connected with the upstream segment 221. A lower driving tooth 222B is formed on an outer wall of the second driving rod 22 in the area connecting the upstream segment 221 with the downstream segment 222. The lower driving tooth 222B has a tooth face generally facing upwardly.

Figure 3:
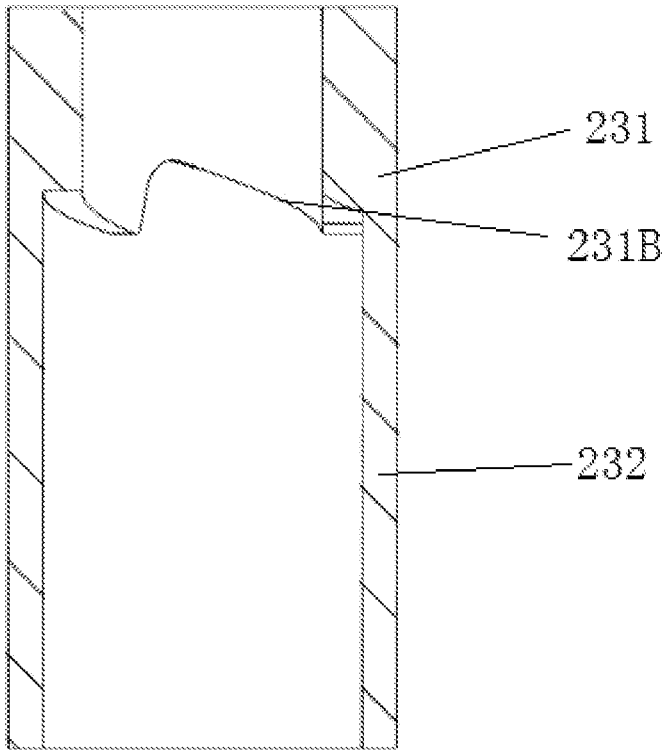
FIG. 3 shows an embodiment of a percussive sleeve of the speed-enhancing drilling tool of FIG. 1.

As shown in FIG. 3, the percussive sleeve 23 includes a first sleeve segment 231 having a relatively small inner diameter, and a second sleeve segment 232 having a relatively large inner diameter, which is located below and connected with the first sleeve segment 231. An upper driving tooth 231B is formed on an inner wall of the percussive sleeve 23 in the area connecting the first sleeve segment 231 with the second sleeve segment 232. The upper driving tooth 231B has a tooth face generally facing downwardly.

When the speed-enhancing drilling tool 1 is in operation, the percussive sleeve 23 is arranged around the second driving rod 22, so that the tooth face of the upper driven tooth 231B and that of the lower driving tooth 222B are opposite to each other, and thus is in engagement with each other. As shown in FIGS. 2 and 3, the lower driving tooth 222B and the upper driven tooth 231B may each be configured as having a wave-like shape extending along a circumferential direction. As shown in FIG. 2, the lower drive tooth 222B is provided with an upward tooth segment that is inclined upwardly along a direction opposite to the rotating direction of the tool, and a downward tooth segment that is inclined downwardly along the direction opposite to the rotating direction. The upward tooth segment and the downward tooth segment are smoothly connected with each other. The upper driven tooth 231B is configured to be in engagement with the lower drive tooth 222B. Therefore, when the second driving rod 22 rotates relative to the percussive sleeve 23, the upward tooth segment of the lower driving tooth 222B are in contact with the corresponding upward tooth segment of the upper driven tooth 231B. Accordingly, the lower driving tooth 222B can push the upper driven tooth 231B upwardly, thereby driving the percussive sleeve 23 to move upwardly relative to the second driving rod 22. This movement proceeds until the peak of the lower driving tooth 222B comes into contact with the valley of the upper driven tooth 231B. As the second driving rod 22 continues to rotate, the downward tooth segment of the lower driving tooth 222B are in contact with the corresponding downward tooth segment of the upper driven tooth 231B. Accordingly, the percussive sleeve 23 can drop down relative to the second driving rod 22, so that the percussive sleeve 23 can generate axial downward impact on the rotary rod 26 connected with the lower end of the second driving rod 22.

In a preferred embodiment, the inclination of the above-mentioned upward tooth segment is smaller than that of the downward tooth segment. Further preferably, the inclination of the tooth face of the upward tooth segment is approximately between 0 degrees and 15 degrees, such as 8 degrees. The inclination of the tooth face of the downward tooth segment is in a range from about 75 degrees to 90 degrees, such as 83 degrees. Therefore, the friction torque consumed when the percussive sleeve 23 ascends will be less than about 20% of the actual output torque of the first rotary rod 15 and the second rotary rod 22. At the same time, the percussive sleeve 23 is allowed to fall relatively fast to generate strong impact on the rotary rod 26. In addition, the upper tooth segment and the lower tooth segment are connected with each other through a smooth transition, for avoiding or reducing stress concentration.

Figure 4:
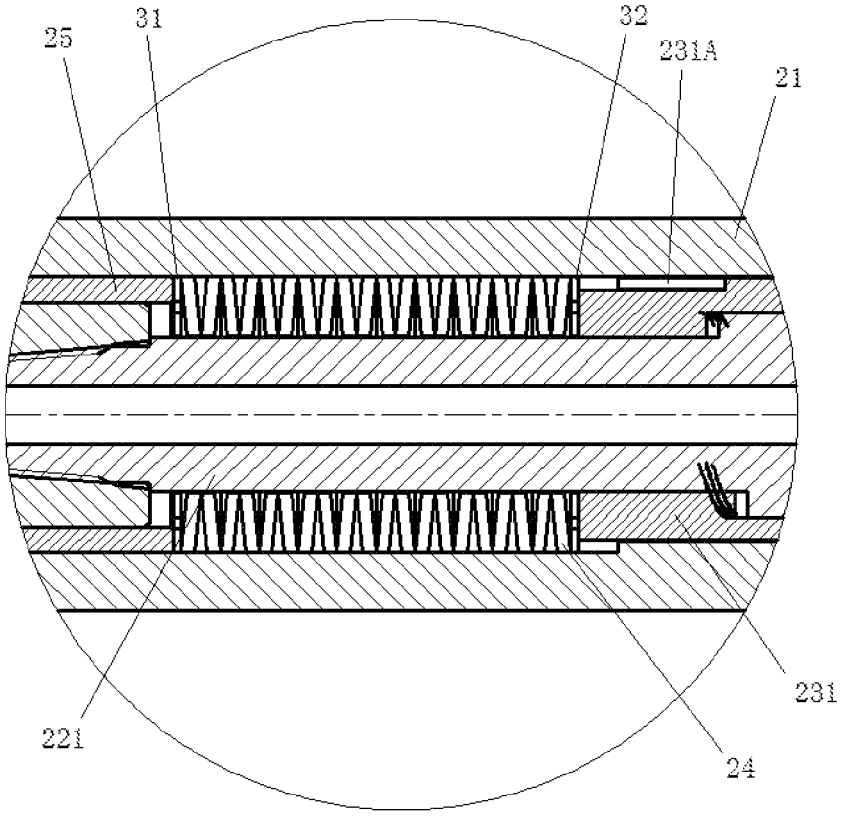
FIG. 4 schematically shows a part of the speed-enhancing drilling tool of FIG. 1.

As shown in FIG. 4, the percussive device 20 includes an outer shell 21 arranged around the second rotary rod 22, the percussive sleeve 23 and the rotary rod 26. An orienting key 231A extending along the axial direction is arranged on an outer side wall of the percussive sleeve 23. An orienting slot extending along the axial direction and in engagement with the orienting key 231A is arranged on an inner side wall of the outer shell 21. When the orienting key 231A is inserted into the orienting slot, the percussive sleeve 23 can move relative to the outer shell 21 along the axial direction, but not rotate relative thereto. This arrangement is beneficial to ensure the relative rotation between the second driving rod 22 and the percussive sleeve 23. The outer shell 21 is disposed at the lower end of the housing 11, and has an upper end fixedly connected with the lower end of the housing 11. For example, the lower end of the housing 11 is inserted into an inner cavity of the outer shell 21, and they are connected with each other by means of a drill pipe joint thread.

In addition, as shown in FIG. 4 also, an elastic member 24 is provided above the percussive sleeve 23. Specifically, the elastic member 24 is arranged between the outer shell 21 and the upstream segment 221 of the second driving rod 22. For example, the elastic member 24 has a lower end abutting against the upper end of the percussive sleeve 23, and an upper end abutting against a lower end of a support sleeve 25. The support sleeve 25 extends along the axial direction, and has an upper end abutting against the lower end of the drill housing 11, which is inserted into the upper end of the outer shell 21. In this manner, the upper end of the elastic member 24 can be fixed at an appropriate position. However, it should be understood that the upper end of the elastic member 24 may also be fixed in other ways. When the percussive sleeve 23 moves upward relative to the second driving rod 22, the elastic member 24 will be compressed. Subsequently, the elastic member 24 can push the percussive sleeve 23 to move downward to apply impacts on the rotary rod 26. The elastic member 24 can be, for example, a coil spring, a disc spring, or the like. Considering the bearing capacity and the service life of the elastic member 24, the elastic member 24 is preferably a disc spring.

In a preferred embodiment, washers 31 and 32 are arranged between the upper end of the elastic member 24 and the support sleeve 25, and between the lower end of the elastic member 24 and the percussive sleeve 23, respectively. For example, the washer can be made of alloy steel having surfaces being metallurgically bonded with S201 material or DT30 material. Wear between the elastic member 24 and other members can be avoided by the washers 31 and 32.

Figure 5:
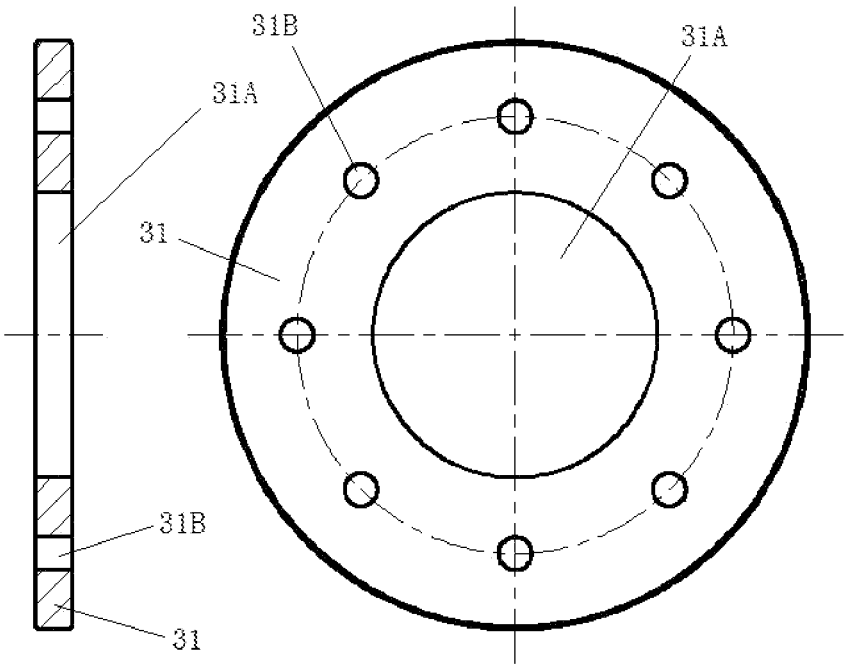
FIG. 5 shows an embodiment of a washer of the speed-enhancing drilling tool of FIG. 1.

FIG. 5 shows one embodiment of the washer 31. The washer 31 is annular, with a center hole 31A passing through the washer 31 along the axial direction in the center thereof. Therefore, the washer 31 can be arranged around the second driving rod 22. In addition, the washer 31 is further provided at its peripheral portion with at least one through hole 31B passing through the washer 31 along the axial direction. Preferably, the center of the through hole 31B is located on a circle which is equidistantly spaced from an inner wall surface and an outer wall surface of the washer 31. Further preferably, a plurality of the through holes 31B are provided, and evenly distributed from each other along the circumferential direction. For example, eight evenly distributed through holes 31B are provided on the washer 31. By means of the washer 31 with through holes 31B, harmful effects, such as cavitation caused by rapid change of fluid pressure during expansion and compression of the spring, can be effectively avoided. This is beneficial to ensure structural integrity of the elastic member 24 and its neighboring members, thereby facilitating to prolong the service life of the speed-enhancing drilling tool 1. It should be understood that the washer 32 may have the same configuration also.

As shown in FIG. 1, the rotary rod 26 includes a first rotating segment 261, a second rotating segment 262, and a third rotating segment 263, which are connected in sequence from top to bottom. An outer diameter of the first rotating segment 261 is smaller than that of the second rotating segment 262, which is, in turn, smaller than that of the third rotating segment 263. The first rotating segment 261 and the second rotating segment 262 are both arranged within the outer shell 21, while the third rotating segment 263 is located therebelow. The third rotating segment 263 is connected to the downstream drill bit, so as to drive the downstream drill bit in rotation. A step surface 262D facing upward (see FIGS. 7 and 10) is formed at a connection between the first rotating segment 261 and the second rotating segment 262. The step surface 262D is configured to be opposite to the lower end face of the percussive sleeve 23. When the percussive sleeve 23 moves downward, the lower end face of the percussive sleeve 23 comes in contact with the step surface 262D, thus applying impacts on the rotary rod 26. In addition, preferably, when the lower end face of the percussive sleeve 23 is in contact with the step surface 262D, an axial gap still exists between the lower driving tooth 222B and the upper driven tooth 231B. That is, the peak of the lower driving tooth 222B is axially spaced from that of the upper driven tooth 231B, while the valley of the lower driving tooth 222B is axially spaced from that of the upper driven tooth 231B. With this arrangement, direct impact between the upper driven tooth 231B and the lower driving tooth 222B can be avoided, thereby preventing the upper driven tooth 231B and the lower driving tooth 222B from damages.

The second driving rod 22 and the rotary rod 26 can be coupled with each other, for example, by means of key connection, so as to ensure that the second driving rod 22 can drive the rotary rod 26 to rotate together, but the rotary rod 26 can move relative to the second driving rod 22 along the axial direction.

Figure 6:
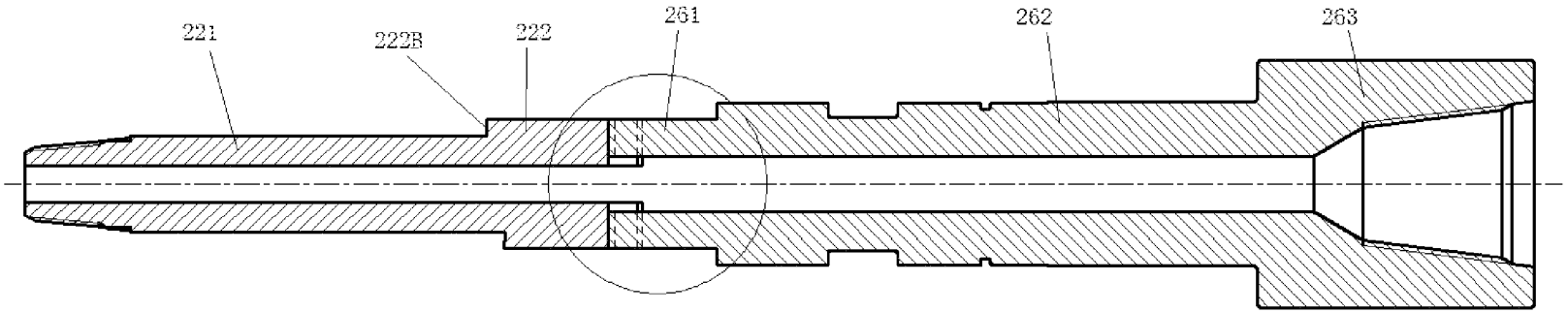
FIGS. 6 to 8 show an embodiment of engagement between the second driving rod and a rotary rod of the speed-enhancing drilling tool of FIG. 1.
Figure 7:
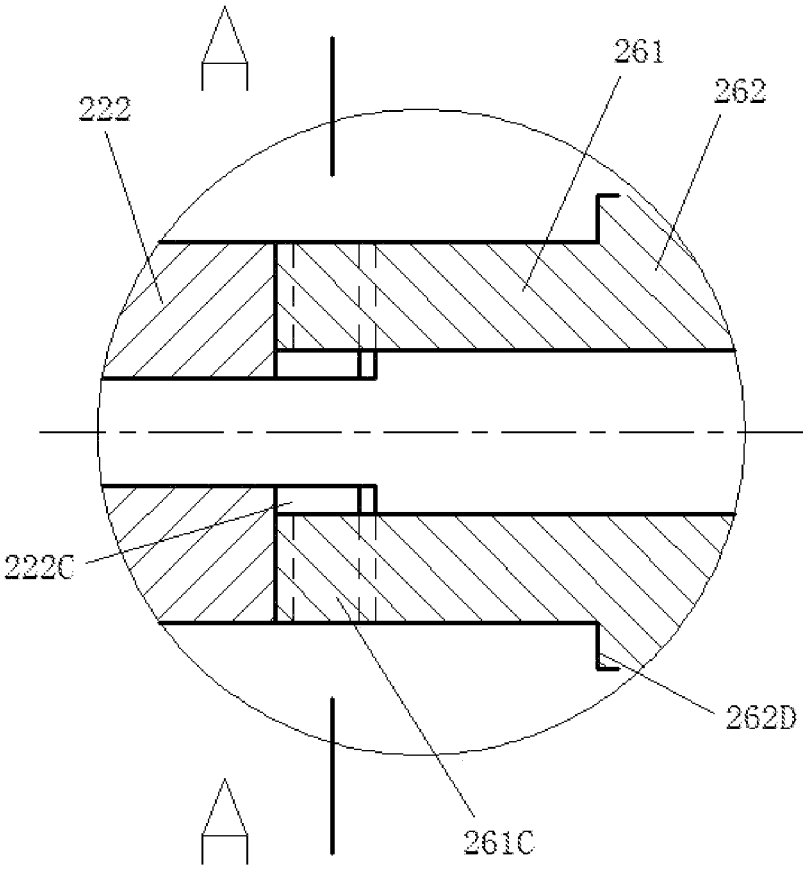
Figure 8:
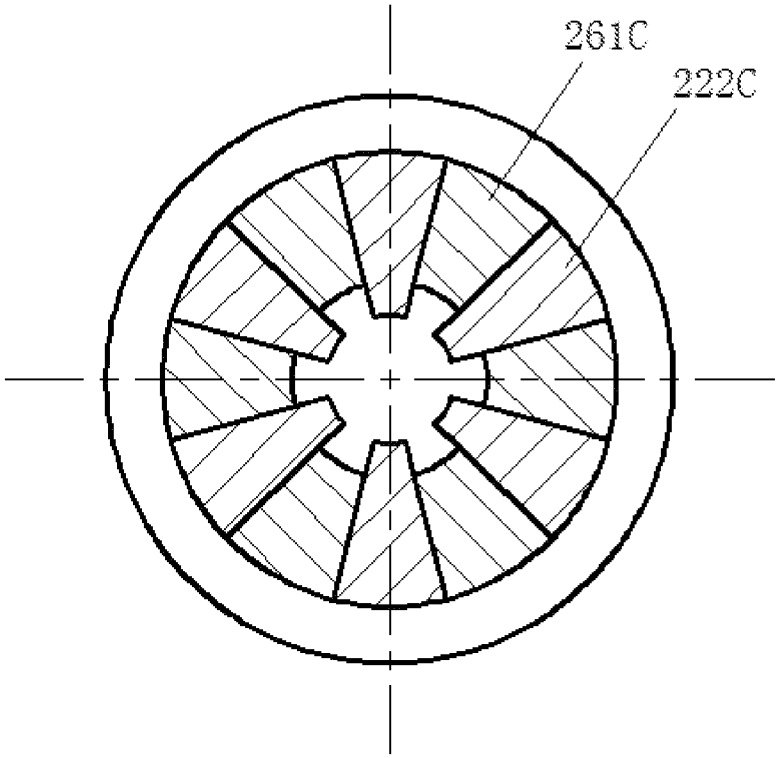

In the embodiment shown in FIGS. 6 to 8, a plurality of driving keys 222C extending along the axial direction is arranged at the lower end of the second driving rod 22, while a plurality of mating keys 261C extending along the axial direction is arranged at the upper end of the rotary rod 22. As shown in FIG. 8, the plurality of driving keys 222C and the plurality of mating keys 261C are alternatively embedded with each other. Accordingly, the rotary rod 26 can rotate along with the second driving rod 22 and move relative thereto in the axial direction. Preferably, a chamfer of, say, degrees, is formed between an end face of each mating key 261C and each of two side wall faces thereof, so that each mating key 261C can be smoothly inserted into a gap formed between adjacent driving keys 222C. At the same time, each driving key 222C also has the same or similar chamfer (dotted lines in FIGS. 6 and 7), for facilitating inserting operation between the driving key 222C and the mating key 261C.

Figure 9:
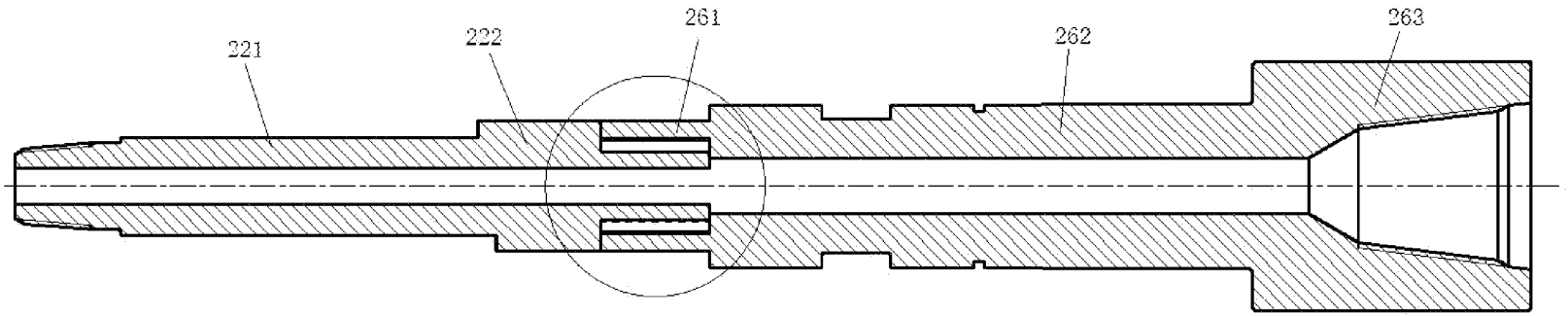
FIGS. 9 to 11 show another embodiment of the engagement between the second driving rod and the rotary rod of the speed-enhancing drilling tool of FIG. 1.
Figure 10:
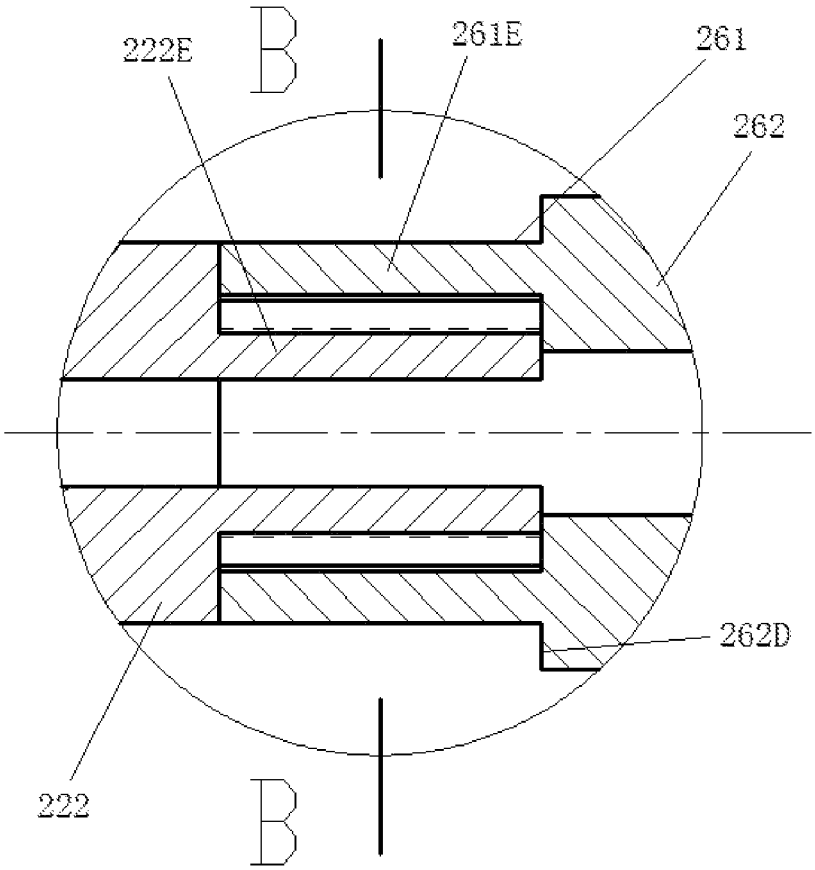
Figure 11:
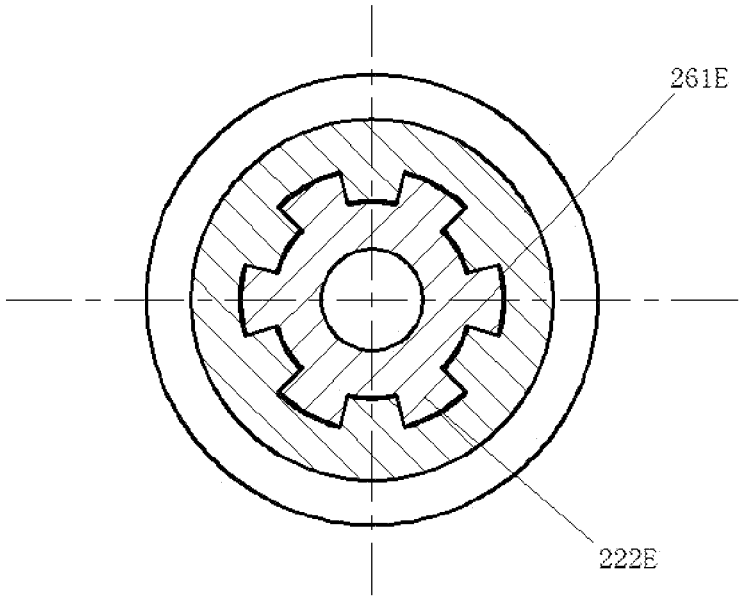

In the embodiment shown in FIGS. 9 to 11, driving keys 222E extending in the axial direction are arranged on the outer side wall at the lower end of the second driving rod 22, and driving slots 261E extending in the axial direction are arranged on the inner side wall at the upper end of the rotary rod 26. As shown in FIG. 11, each driving key 222E is inserted into a corresponding one of the driving slots 261E. Accordingly, the rotary rod 26 can rotate along with the second driving rod 22, and move relative thereto in the axial direction. Of course, in order to facilitate installation, as shown in FIGS. 9 and 10, the end face of each driving key 222E is connected with each of two side walls thereof through a chamfer. Similarly, the end face formed between adjacent driving slots 261E is also connected to each of two side walls thereof through a chamfer.

In addition, as shown in FIG. 1, a wear-resistant joint 29 is connected at the lower end of the outer shell 21. An upper end of the wear-resistant joint 29 is inserted into the lower end of the outer shell 21, for example, by means of drill pipe joint threads. The outer surface of the second rotating segment 262 of the rotary rod 26 is formed with an accommodating groove, in which limiting blocks 27, 27' protruding radially outward relative to the outer side wall of the second rotating segment 262 are arranged. The limiting blocks 27 and 27' are located above the wear-resistant joint 29, and opposite to an upper end face thereof. During tripping operations, the rotary rod 26 drives the limiting blocks 27, 27' to drop relative to the outer shell 21, until the limiting blocks 27, 27' are received on the upper end face of the wear-resistant joint 29. In this manner, the limiting blocks 27, 27' can be used to restrict the axial movement range of the rotary rod 26 relative to the wear-resistant joint 29 and the outer shell 21.

Figure 12:
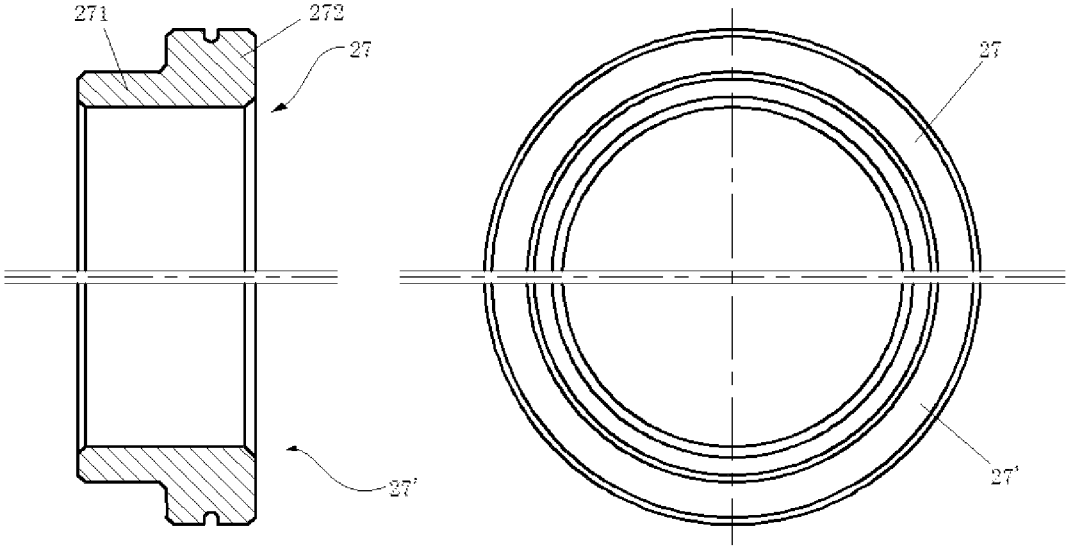
FIG. 12 shows an embodiment of a limiting block of the speed-enhancing drilling tool of FIG. 1.

As shown in FIG. 12, the limiting blocks 27, 27' are each configured as a substantially semicircular member. The limiting blocks 27, 27' can be received in the accommodating groove, thus substantially covering the entire periphery of the second rotating segment 262. In a preferred embodiment, the limiting block 27 includes a first matching segment 271 having a relatively small outer diameter, and a second matching segment 272 having a relatively large outer diameter and located below and connected with the first matching segment 271. The limiting block 27 is sandwiched between the outer shell 21 and the second rotating segment 262. An outer side wall of the second matching segment 272 is in engagement with the outer shell 21, and a sealing member may be arranged therebetween, for preliminarily sealing the drilling fluid injected into a space between the outer shell 21 and the rotary rod 26, thus preventing the drilling fluid from flowing into the annulus. The sealing member can be, for example, a RODI rotary seal. A separating space, in which a mounting sleeve 28 is disposed, is formed between the first mating segment 271 and the outer shell 21. The mounting sleeve 28 extends upwardly to a space between the second rotating segment 262 and the outer shell 21. The mounting sleeve 28 is in engagement with the first matching segment 271 through a transition fit, so that the limiting block 27 can be stably held in the accommodating groove by the mounting sleeve 28. During the operation of the speed-enhancing drilling tool 1, the limiting block 27 will not vibrate erratically with respect to the outer shell 21 and the second rotating segment 262. In this way, unintended wear between the limiting block 27, the outer shell 21 and the second rotating segment 262 can be avoided, and the situation that the limiting block 27 is stuck unexpectedly so that it is unable to move smoothly relative to the outer shell 21, can be also avoided. The limiting block 27' may have the same configuration also. With this arrangement, it can be ensure that the drilling operations of the speed-enhancing drilling tool 1 can perform smoothly.

Moreover, the wear-resistant joint 29 extends radially inward with respect to the outer shell 21, for sealing engagement with the lower end portion of the second rotating segment 262. This sealing, which can be achieved, for example, by means of a Hunger RODI rotary seal, acts as a secondary sealing for the drilling fluid injected in the space between the outer shell 2 and the rotary rod 26, thus further preventing the drilling fluid from leaking into the annulus. At a position where the wear-resistant joint 29 and the second rotating segment 262 are in contact with each other, a diamond or PDC wear-resistant strip is embedded on the inner side wall of the wear-resistant joint 29 and/or on the outer side wall of the second rotating segment 262, in order to improve the wear resistance between the wear-resistant joint 29 and the second rotating segment 262, thereby prolonging the service life of both.

The specific working process of the above speed-enhancing drilling tool 1 is as follows.

First, the above-mentioned speed-enhancing drilling tool 1 is lowered into the well to be drilled. During this process, the rotary rod 26 moves downward relative to the second driving rod 22 and the outer shell 21 to a position where the limiting blocks 27 and 27' abut against the upper end face of the wear-resistant joint 29.

When the downstream drilling bit of the speed-enhancing drilling tool 1 touches the bottom of the well, the speed-enhancing drilling tool 1 is further lowered, so that the rotary rod 26 moves upward relative to the second driving rod 22 and the outer shell 21, until the upper end face of the rotary rod 26 abuts against the support sleeve 25.

Then, drilling operation starts. During operation, the downstream drilling bit acts on the formation. The rotary rod 26 and the downstream drilling bit rotate along with the first driving rod and the second driving rod 22. At the same time, the percussive sleeve 23 reciprocally moves up and down relative to the rotary rod 26 under the action of the elastic member 24 and the second driving rod 22. As moving downward, the percussive sleeve 23 impacts on the rotary rod 26 in the axial direction, thereby causing percussion of the downstream drilling bit toward the formation.

The above-mentioned speed-enhancing drilling tool 1 can generate high-frequency and high-power impact, thus effectively increasing the rate and strength of rock-breaking in formations and greatly improving the drilling efficiency.

Moreover, the above drilling tool 1 does not have any weak part in structure, which is beneficial to improve the structural stability of the speed-enhancing drilling tool 1 and prolong the service life thereof.

Although the present invention has been described with reference to the preferred embodiments, various modifications may be made and equivalents may be substituted for components thereof without departing from the scope of the present invention. In particular, under the condition that there is no structural conflict, each technical feature mentioned in each embodiment can be combined in any manner. The present invention is not limited to the specific embodiments disclosed herein, but includes all technical solutions falling within the scope of the claims.

The invention claimed is:

1. A speed-enhancing drilling tool, comprising:

an upstream drill string, including a drive motor and a first driving rod coupled with the drive motor, wherein the first driving rod extends in an axial direction, and the drive motor is configured to drive the first driving rod in rotation;

a downstream drilling bit; and a percussive device installed between the upstream drilling string and the downstream drilling bit, and configured to generate impact on the downstream drilling bit in the axial direction, the percussive device comprising:

a rotary driving part configured to rotate around its axis, and having an upper end engaged with the first driving rod to rotate together with the first driving rod;

a rotary working part having an upper end engaged with a lower end of the rotary driving part and a lower end connected with the downstream drilling bit, wherein the rotary working part is configured to be driven by the rotary driving part to rotate about its axis, and axially movable relative to the rotary driving part; and a percussion generating part arranged around the rotary working part and having an upper end abutting against an elastic member, wherein the percussion generating part is configured to move along the axial direction relative to the rotary working part, so as to impact the rotary working part downwardly along the axial direction under action of the elastic member, wherein the rotary driving part further comprises a second driving rod connected to a lower end of the first driving rod, and the second driving rod comprises an upstream segment and a downstream segment connected to the upstream segment, an outer diameter of the upstream segment being smaller than that of the downstream segment, wherein a lower driving tooth with an upwardly facing surface is formed on an outer wall of the second driving rod at an area connecting the upstream segment with the downstream segment, wherein the percussion generating part further comprises a percussive sleeve arranged around the second driving rod, the percussive sleeve including a first sleeve segment and a second sleeve segment located below and connected with the first sleeve segment, an inner diameter of the first sleeve segment being smaller than that of the second sleeve segment, wherein an upper driven tooth with a downwardly facing surface is formed on an inner wall of the percussive sleeve at an area connecting the first sleeve segment with the second sleeve segment, and the percussive sleeve is able to reciprocally move axially relative to the second driving rod under cooperation of the lower driving tooth and the upper driven tooth when the second driving rod rotates relative to the percussive sleeve.

2. The speed-enhancing drilling tool according to claim 1, wherein the upper driven tooth and the lower driving tooth are each configured with an upward tooth segment that is inclined upwardly in a direction opposite to a rotating direction, and a downward tooth segment that is connected with the upward tooth segment and inclined downwardly in the direction opposite to the rotating direction, wherein an inclination of the upward tooth segment is smaller than that of the downward tooth segment.

3. The speed-enhancing drilling tool according to claim 2, wherein an orienting key extending in the axial direction is formed on an outer side wall of the percussive sleeve, and the percussive device further includes an outer shell, at least a part of which surrounds the percussive sleeve, and an orienting slot extending in the axial direction is formed on an inner side wall of the outer shell, wherein the orienting key is inserted into the orienting slot and moveable in the orienting slot along the axial direction, so that the percussive sleeve is fixed relative to the outer shell in the circumferential direction and moveable relative thereto along the axial direction.

4. The speed-enhancing drilling tool according to claim 2, wherein the elastic member is arranged above the percussive sleeve, and a washer is arranged between the percussive sleeve and the elastic member, wherein the washer is provided with a through hole axially passing through the washer, the through hole being configured to allow fluid to pass therethrough during compression and recovery of the elastic member.

5. The speed-enhancing drilling tool according to claim 1, wherein the rotary working part comprises a rotary rod, which has a lower end connected with the downstream drilling bit, and an upper end connected with the lower end of the second driving rod through a key, so that the rotary rod is fixed relative to the second driving rod in a circumferential direction and moveable relative thereto in the axial direction.

6. The speed-enhancing drilling tool according to claim 5, wherein multiple driving keys extending in the axial direction are formed at the lower end of the second driving rod, and spaced apart from each other in the circumferential direction, and multiple mating keys extending in the axial direction are formed at the upper end of the rotary rod, and spaced apart from each other in the circumferential direction, wherein said multiple driving keys and said multiple mating keys are alternately mated with each other in the circumferential direction.

7. The speed-enhancing drilling tool according to claim 2, wherein the rotary rod comprises a first rotating segment, and a second rotating segment located below and connected with the first rotating segment, an outer diameter of the first rotating segment being smaller than that of the second rotating segment, wherein a step surface facing upward is formed at an area connecting the first rotating segment with the second rotating segment, and a lower end face of the percussive sleeve is opposite to the step surface, and an axial gap exists between the upper driven tooth and the lower driving tooth when the lower end face of the percussive sleeve is in contact with the step surface.

8. The speed-enhancing drilling tool according to claim 6, wherein an orienting key extending in the axial direction is formed on an outer side wall of the percussive sleeve, and the percussive device further includes an outer shell, at least a part of which surrounds the percussive sleeve, and an orienting slot extending in the axial direction is formed on an inner side wall of the outer shell, wherein the orienting key is inserted into the orienting slot and moveable in the orienting slot along the axial direction, so that the percussive sleeve is fixed relative to the outer shell in the circumferential direction and moveable relative thereto along the axial direction.

9. The speed-enhancing drilling tool according to claim 6, wherein the elastic member is arranged above the percussive sleeve, and a washer is arranged between the percussive sleeve and the elastic member, wherein the washer is provided with a through hole axially passing through the washer, the through hole being configured to allow fluid to pass therethrough during compression and recovery of the elastic member.

10. The speed-enhancing drilling tool according to claim 5, wherein the driving keys extending in the axial direction are formed on an outer side wall at the lower end of the second driving rod, and driving slots extending in the axial direction are formed on an outer side wall of the upper end of the rotary rod, wherein each driving key is inserted into a corresponding driving slot to move in said corresponding drive slot along the axial direction.

11. The speed-enhancing drilling tool according to claim 10, wherein an orienting key extending in the axial direction is formed on an outer side wall of the percussive sleeve, and the percussive device further includes an outer shell, at least a part of which surrounds the percussive sleeve, and an orienting slot extending in the axial direction is formed on an inner side wall of the outer shell, wherein the orienting key is inserted into the orienting slot and moveable in the orienting slot along the axial direction, so that the percussive sleeve is fixed relative to the outer shell in the circumferential direction and moveable relative thereto along the axial direction.

12. The speed-enhancing drilling tool according to claim 5, wherein the rotary rod comprises a first rotating segment, and a second rotating segment located below and connected with the first rotating segment, an outer diameter of the first rotating segment being smaller than that of the second rotating segment, wherein a step surface facing upward is formed at an area connecting the first rotating segment with the second rotating segment, and a lower end face of the percussive sleeve is opposite to the step surface, and an axial gap exists between the upper driven tooth and the lower driving tooth when the lower end face of the percussive sleeve is in contact with the step surface.

13. The speed-enhancing drilling tool according to claim 12, wherein an accommodating groove is formed on an outer side wall of the second rotating segment, and a limiting block protruding radially outward relative to the outer side wall of the second rotating segment is arranged in the accommodating groove, the percussive device further includes an outer shell, at least a part of which surrounds the second rotating segment, so that the limiting block is sandwiched between the second rotating segment and the outer shell, a wear-resistant joint is connected to a lower end of the outer shell, and has an upper end inserted into the lower end of the outer shell, wherein an upper end face of the wear-resistant joint is opposite to the limiting block, for restricting axial movement range of the limiting block, wherein the limiting block includes a first matching segment and a second matching segment located below and connected with the first matching segment, an outer diameter of the first matching segment being smaller than that of the second matching segment, wherein an outer side wall of the second matching segment is in engagement with an inner wall of the outer shell, while a separating space is formed between the first matching segment and the outer shell, and a mounting sleeve is provided between the outer shell and the second rotating segment in an area above the limiting block, the mounting sleeve extending into the separating space to maintain a radial position of the limiting block.

14. The speed-enhancing drilling tool according to claim 5, wherein an orienting key extending in the axial direction is formed on an outer side wall of the percussive sleeve, and the percussive device further includes an outer shell, at least a part of which surrounds the percussive sleeve, and an orienting slot extending in the axial direction is formed on an inner side wall of the outer shell, wherein the orienting key is inserted into the orienting slot and moveable in the orienting slot along the axial direction, so that the percussive sleeve is fixed relative to the outer shell in the circumferential direction and moveable relative thereto along the axial direction.

15. The speed-enhancing drilling tool according to claim 5, wherein the elastic member is arranged above the percussive sleeve, and a washer is arranged between the percussive sleeve and the elastic member, wherein the washer is provided with a through hole axially passing through the washer, the through hole being configured to allow fluid to pass therethrough during compression and recovery of the elastic member.

16. The speed-enhancing drilling tool according to claim 1, wherein an orienting key extending in the axial direction is formed on an outer side wall of the percussive sleeve, and the percussive device further includes an outer shell, at least a part of which surrounds the percussive sleeve, and an orienting slot extending in the axial direction is formed on an inner side wall of the outer shell, wherein the orienting key is inserted into the orienting slot and moveable in the orienting slot along the axial direction, so that the percussive sleeve is fixed relative to the outer shell in the circumferential direction and moveable relative thereto along the axial direction.

17. The speed-enhancing drilling tool according to claim 1, wherein the elastic member is arranged above the percussive sleeve, and a washer is arranged between the percussive sleeve and the elastic member, wherein the washer is provided with a through hole axially passing through the washer, the through hole being configured to allow fluid to pass therethrough during compression and recovery of the elastic member.

* * * * *